US006412738B1

(12) United States Patent
Bressler et al.

(10) Patent No.: US 6,412,738 B1
(45) Date of Patent: Jul. 2, 2002

(54) PORTABLE STENOGRAPHIC MACHINE STAND

(75) Inventors: Peter W. Bressler, Philadelphia, PA (US); Peter D. Byar, Willingboro, NJ (US); Paul K. Rossi, Jacksonville, FL (US); Michael J. Cahill, 106 Middleton Pl., Jeffersonville, PA (US) 19403

(73) Assignee: Michael J. Cahill, Jeffersonville, PA (US)

( * ) Notice: Subject to any disclaimer, the term of this patent is extended or adjusted under 35 U.S.C. 154(b) by 0 days.

(21) Appl. No.: 09/454,402

(22) Filed: Dec. 3, 1999

(51) Int. Cl.[7] ..... F16M 11/00

(52) U.S. Cl. ..... 248/176.1; 248/176.3; 248/287.1; 248/346.06; 297/173; 297/411.35

(58) Field of Search ..... 248/157, 419, 248/420, 176.1, 183.1, 183.2, 176.3, 125.8, 287.1, 283.1, 346.06; 297/173, 170, 411.35, 188.01; 108/27, 49, 94, 138

(56) References Cited

U.S. PATENT DOCUMENTS 2,954,955 A 10/1960 Feller
3,638,776 A 2/1972 Ridge
4,815,688 A * 3/1989 Wood ..... 248/283
4,913,393 A * 4/1990 Wood ..... 248/283
5,161,766 A 11/1992 Arima
5,169,210 A * 12/1992 Fricano ..... 297/188
5,275,465 A 1/1994 Gulliver et al.
5,462,247 A 10/1995 Aldrich
5,653,499 A 8/1997 Goodall
5,755,650 A * 5/1998 Urso ..... 482/138
5,893,607 A * 4/1999 Trimnell ..... 297/170
5,947,428 A * 9/1999 Ohl ..... 248/118

* cited by examiner

*Primary Examiner*—Leslie A. Braun
*Assistant Examiner*—Tan Le
(74) *Attorney, Agent, or Firm*—Akin, Gump, Strauss, Hauer & Feld, L.L.P.

(57) ABSTRACT

A stand for supporting a stenographic machine from a chair is provided. The stand includes a chair clamp releasably mountable to the seat portion of the chair. The chair clamp is adjustable along a longitudinal axis of the chair clamp. A support which has first and second ends is pivotally connected to the chair clamp at the first end. The support includes a first portion telescopically connected to a second portion. The second portion is rotatably connected to a third portion. A stabilizer which is adapted to engage a bottom of the seat portion extends from the first end of the support. An arm which is adapted to support an operator's forearm extends from the second end of the support. A connector which is adapted to releasably connect a stenographic machine to the stand is connected to the second end of the support.

14 Claims, 7 Drawing Sheets

PORTABLE STENOGRAPHIC MACHINE STAND

BACKGROUND OF THE INVENTION

Court stenographers and reporters generally record spoken words uttered during court and other legal proceedings on a stenographic machine. The stenographic machine includes a series of keys which are manipulated by the stenographer to produce a shorthand-type code that is later transcribed into a transcript of the proceeding. The stenographic machine is typically mounted on a stand which includes a single vertically adjustable post which is supported by a tripod. The stand is generally lightweight and collapsible to enable the stenographer to readily transport the stand with the stenographic machine, as may be required to attend proceedings outside of a courtroom.

In use, the stenographic machine is generally situated in front of and between the legs of the stenographer, who is seated. The stenographer must generally lean forward in the seat to be able to properly reach and operate the keys. The configuration and location of the tripod also generally preclude the stenographer from extending his/her legs or extending his/her legs off to the side of the tripod. The required placement of the stenographic machine relative to the seated stenographer generally results in physical discomfort to the stenographer, particularly in the back and legs.

It would be beneficial to provide a stand that allows the stenographer to extend his/her legs and to adjust the location of the stenographic machine to allow the stenographer to maneuver the stenographic machine to a comfortable position, yet still be collapsible and lightweight for easy transport.

BRIEF SUMMARY OF THE INVENTION

In one aspect, the present invention is a stand for supporting a stenographic machine from a chair, the chair including a seat portion. The stand comprises a chair clamp releasably mountable to the seat portion; a support having first and second ends, the first end extending from the chair clamp; and a connector connected to the second end of the support, the connector being adapted to releasably lock the stenographic machine to the stand.

In another aspect, the present invention is a stand for supporting a stenographic machine from a chair, the chair including a seat portion. The stand comprises a chair clamp releasably mountable to the seat portion, the chair clamp being adjustable along a longitudinal axis of the chair clamp; a support extending from the chair clamp, the support having first and second ends, the first end being pivotally connected to the chair clamp, the support including a first portion telescopically connected to a second portion, and the second portion being telescopically connected to a third portion; a stabilizer extending from the first end of the support, the stabilizer being adapted to engage a bottom of the seat portion; an arm extending from the second end of the support, the arm being adapted to support an operator's forearm; and a connector connected to the third portion, the connector being adapted to releasably secure the stenographic machine to the stand.

BRIEF DESCRIPTION OF THE SEVERAL VIEWS OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shoe. In the drawings.

DETAILED DESCRIPTION OF THE INVENTION

Figure 1:
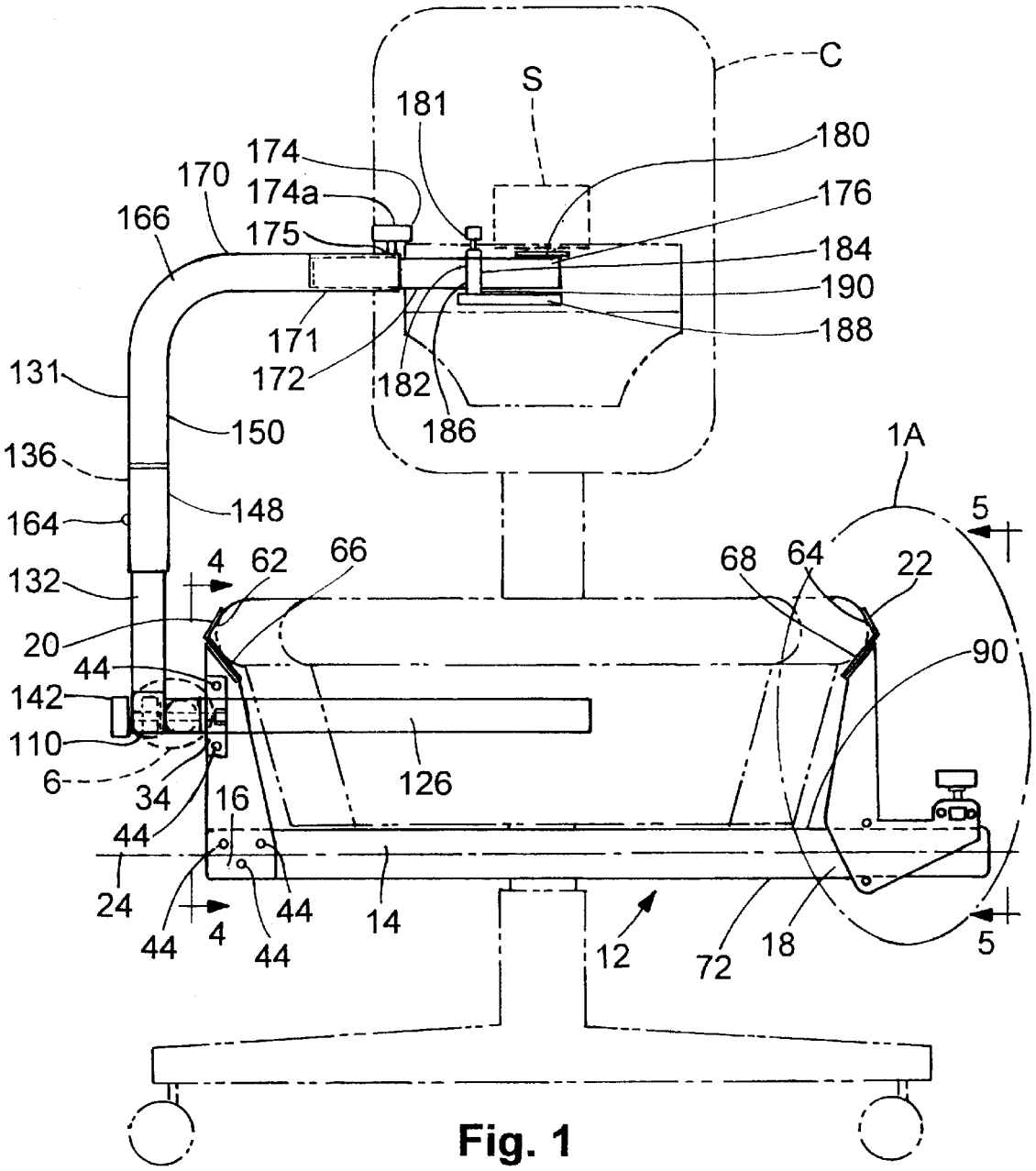
FIG. 1 is a front elevational view of a stand for a stenographic machine according to a preferred embodiment of the present invention.

Certain terminology is used in the following description for convenience only and is not limiting. The words "lower" and "upper" designate directions in the drawings to which reference is made. The words "inwardly" and "outwardly" refer to directions toward and away from, respectively, the geometric center of the stand and designated parts thereof. The word "a" is defined to mean "at least one". The terminology includes the words above specifically mentioned, derivatives thereof and words of similar import. In the drawings, like numerals are used to indicate like elements throughout.

Figure 2:
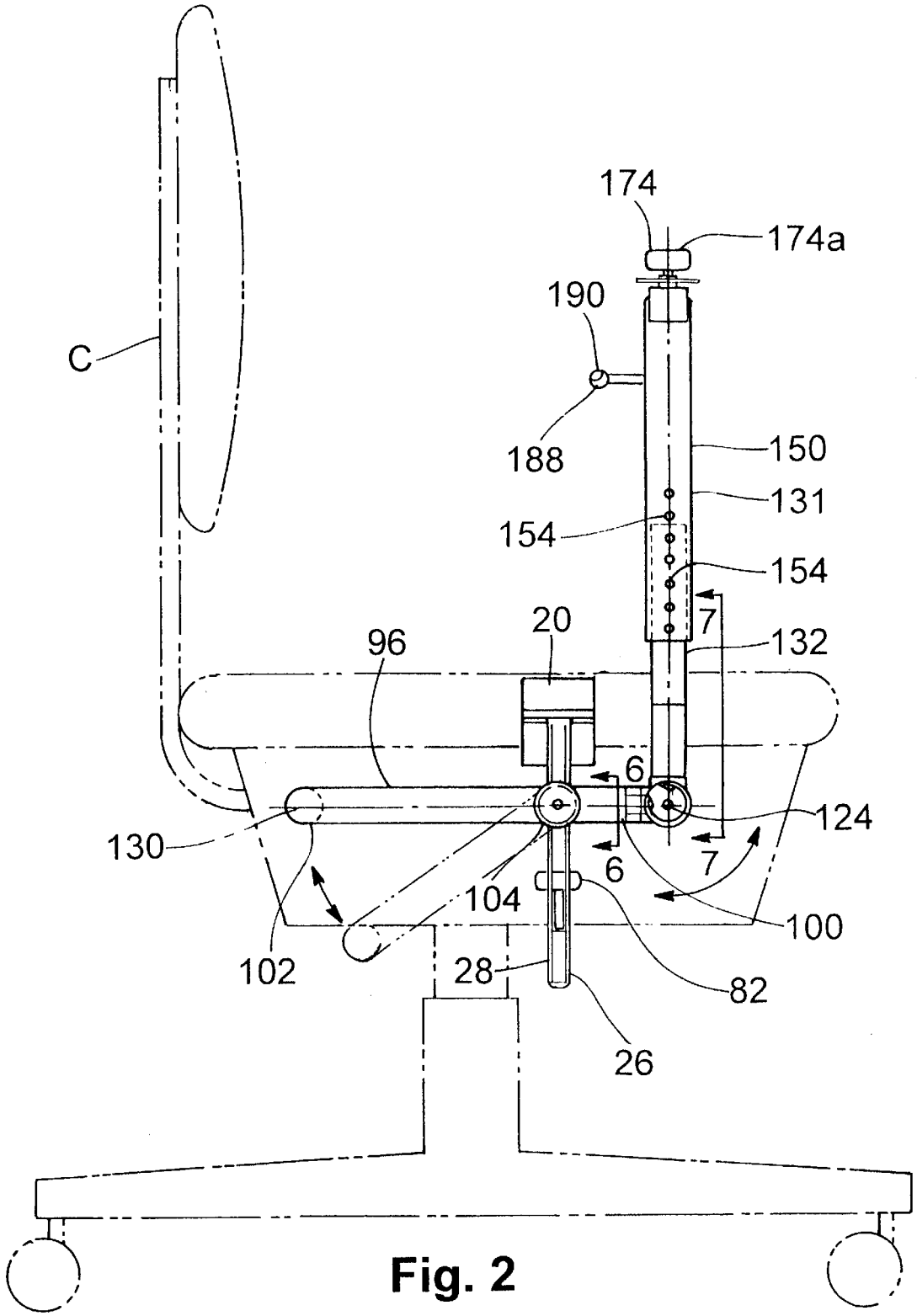
FIG. 2 is a left side elevational view of the stand.
Figure 3:
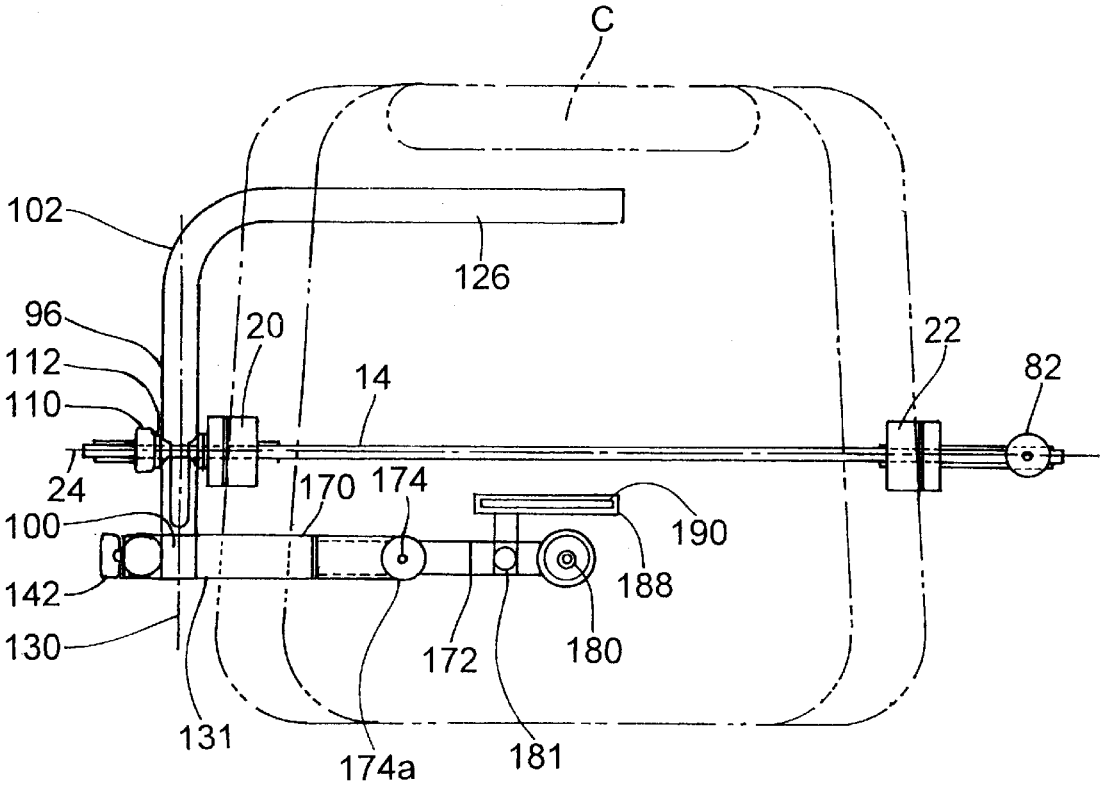
FIG. 3 is a top plan view of the stand.

There is shown in the various figures a preferred embodiment (or its components) of a stenographic machine stand 10 (hereinafter "stand 10") of the present invention for supporting a stenographic machine "S" from a chair "C" having a seat portion. Referring to FIGS. 1–3, the stand 10 generally includes a chair clamp 12 which is releasably mountable to the seat portion of the chair C. A support 131 having a first end 134 and a second end 176 extends from the chair clamp 12. The support 131 includes an adjustable, generally vertical support 132 which extends upward from the chair clamp 12, a support extension 150 which extends from the support 132 and bends in a generally horizontal position in front of the chair C, and an arm extension 172. A stenographic machine connector in the form of a machine clamp 180 is connected to a second end of the support 131 at the arm extension 172. The clamp 180 is adapted to releasably secure the stenographic machine S to the stand 10. An optional armrest 188 can extend from the support extension 150.

The chair clamp 12 includes a clamp base 14 having a first end 16 and a second end 18. The first end 16 of the clamp 12 includes a first bracket 20 which is preferably fixedly mounted on the first end 16 of the clamp base 14. A second bracket 22 is preferably slidably mounted on the clamp base 14, allowing the chair clamp 12 to be adjustable along a longitudinal axis 24 of the clamp 12 and the base 14 between the first bracket 20 and the second end 18 of the base 14. Those skilled in the art will realize that while it is preferred that the first bracket 20 be fixedly connected to the clamp base 14, the first bracket 20 can also be slidably connected to the clamp base 14 along the longitudinal axis 24 of the clamp base 14.

Figure 4:
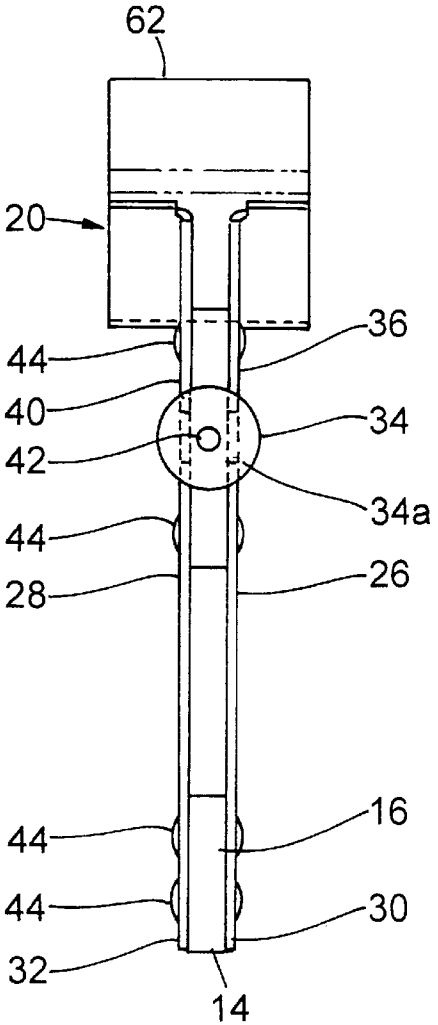
FIG. 4 is an enlarged side elevational view of a first bracket of the stand taken along lines 4—4 of FIG. 1.

Referring now to FIG. 4, the first bracket 20 includes a front portion 26 and a rear portion 28. Preferably, a lower end 30 of the front portion 26 is secured to the front of the clamp base 14 and a lower end 32 of the rear portion 28 is secured to the rear of the clamp base 14. An insert 34 is located between a top end 36 of the front portion 26 and a top end 40 of the rear portion 28. The insert 34 maintains the same spacing between the top ends 36, 40 of the front and rear portions 26, 28 as the spacing between the lower ends 30, 32 of the front and rear portions 26, 28. The insert 34 includes an interiorly threaded channel 42 for reasons that will be explained. Preferably, the top ends 36, 40 and the lower ends 30, 32 of the front and rear portions 26, 28 are connected to each other and to the insert 34 and the clamp base 14, respectively, by rivets 44, although those skilled in the art will realize that the front and rear portions 26, 28 can be connected to the insert 34 and to the clamp base 14 in other manners, including, but not limited to, other mechanical fasteners or welding.

Figure 5:
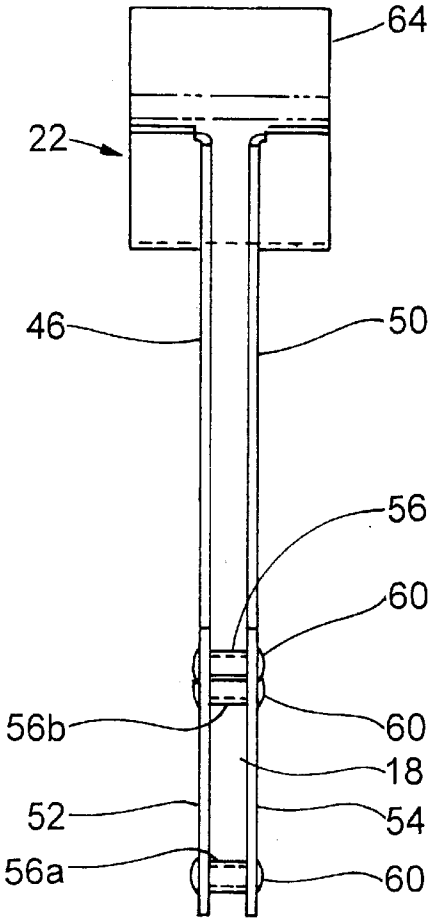
FIG. 5 is an enlarged side elevational view of a second bracket of the stand taken along lines 5—5 of FIG. 1.

Referring to FIGS. 1 and 5, the second bracket 22 includes a front portion 46 and a rear portion 50. Preferably, a lower end 52 of the front portion 46 is slidably connected to the front of the clamp base 14 (clamp base 14 not shown in FIG. 5 for clarity) and a lower end 54 of the rear portion 50 is slidably connected to the rear of the clamp base 14. A plurality of spacers 56 maintain a spacing between the lower ends 52, 54 of the front and rear portions 46, 50. The spacers 56 are sufficiently long to allow the clamp base 14 to be slidingly located between the lower ends 52, 54 of the front and rear portions 46, 50 of the second bracket 22. Preferably, the lower ends 52, 54 of the front and rear portions 46, 50 are connected to each other and to the spacers 56 by rivets 60, although those skilled in the art will realize that the front and rear portions 46, 50 can be connected to the spacers 56 in other manners, including but not limited to, other mechanical fasteners or welding. At least one spacer 56*a* is located below the clamp base 14 and at least one spacer 56*b* is located to ride on top of the base clamp 14 for reasons that will become apparent. Those skilled in the art will recognize that the first and second brackets 20, 22 can be constructed by other methods, including single piece forged or machined construction, and that the first bracket 20 be connected to the clamp base 14 by other methods, including but not limited to, a single piece construction or welding. Additionally, those skilled in the art will recognize that the spacers 56 can be eliminated in such alternate construction means.

Referring back to FIG. 1, each of the first and second brackets 20, 22 includes inwardly facing cradles 62, 64, respectively. Each cradle 62, 64 includes a mounting surface 66, 68 which engages the chair C in a manner which will be described. Preferably, the mounting surfaces 66, 68 are smooth, although those skilled in the art will realize that the mounting surfaces 66, 68 can be textured to provide additional gripping. Those skilled in the art will also realize that cushions or pads (not shown) can also be affixed to the mounting surfaces 66, 68. The cradles 62, 64 are generally "L-shaped" and sized to be able to grip a side of the chair C. Preferably, each cradle 62, 64 is welded to its respective bracket 20, 22, although those skilled in the art will realize that the cradles 62, 64 can be connected to the respective brackets 20, 22 by other means, including, but not limited to, mechanical fasteners.

Figure 1A:
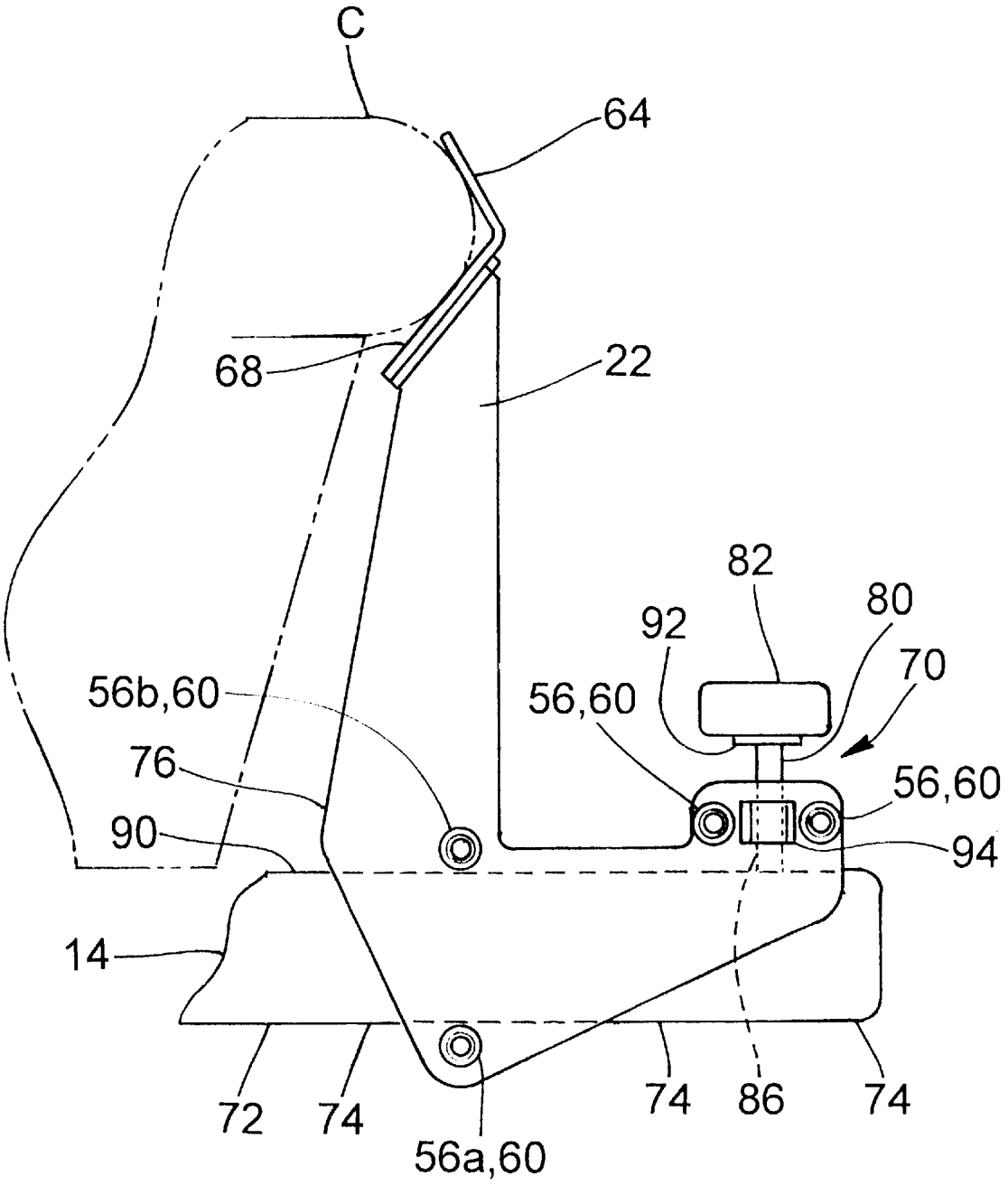
FIG. 1A is an enlarged view of the right bracket of the stand shown in FIG. 1.

Referring to FIGS. 1 and 1A, a stand securing device 70, which is operatively connected to the second bracket 22 for moving the second bracket 22 toward the first bracket 20, will now be described. A lower side 72 of the clamp base 14 proximate to the second end 18 includes a plurality of notches 74, although those skilled in the art will recognize that the notches 74 can be omitted. The spacer 56*a* is located below the clamp base 14 and is adapted to contact and ride along the lower side 72. Preferably, the spacer 56*a* is located on an inward side 76 of the second bracket 22, which side is proximate to the first bracket 20.

The stand securing device 70 further includes a screw 80 with a twist knob handle 82 threadably connected to the second bracket 22 on an outward side of the second bracket 22, which side is distal from the first bracket 20. A free end 86 of the screw 80 is engaged with an upper side 90 of the clamp base 14 in a secured position and is disengaged from the upper side 90 of the clamp base 14 in an unsecured position. Preferably, a spacer 92 is located beneath the twist knob handle 82 to space the twist knob handle 82 from the upper side 90 of the second bracket 22, although those skilled in the art will realize that the spacer 92 need not be used. Also preferably, a captive nut 94 is threadedly connected to the free end 86 of the screw 80 and is retained within the second bracket 22. The captive nut 94 provides a threaded connection on the second bracket 22 for the screw 80. However, those skilled in the art will realize that the captive nut 94 can be eliminated and an internally threaded section of the second bracket 22 can be used instead. Tightening of the screw 80 pivots an engagement end of the second bracket 22, preferably the cradle 64, about the spacer 56*a*, toward the first bracket 20.

Figure 6:
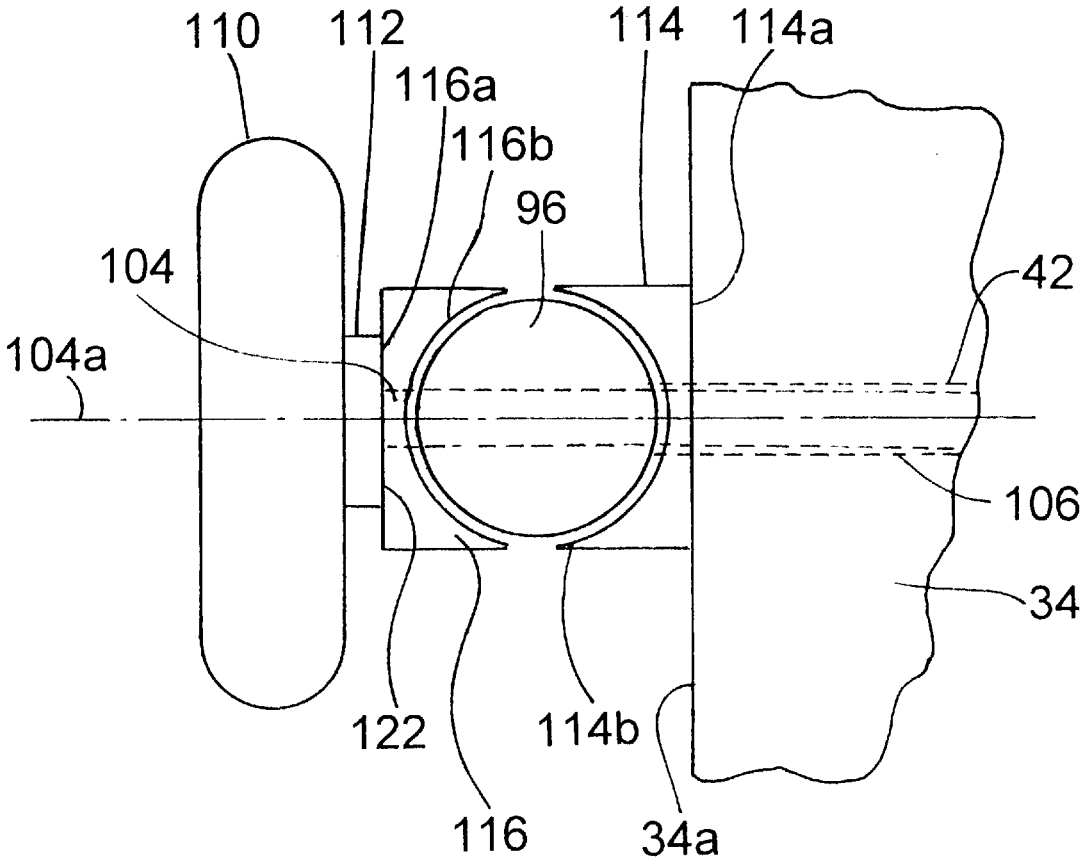
FIG. 6 is an enlarged front view of area 6 of FIG. 1 showing a leg securing device taken along lines 6—6 in FIG. 2.

As shown in FIGS. 3 and 6, a leg 96 has a first leg end 100 and a second leg end 102. The leg 96 is pivotally connected to the chair clamp 12 by having its second leg end 102 pivotally attached to the first bracket 20 about a leg pivot 104 located at the insert 34. Preferably, the leg 96 is constructed of generally tubular aluminum, although those skilled in the art will realize that the leg 96 can be constructed of other material and be of another shape apart from tubular. The leg pivot 104 includes a threaded fastener 106 with a twist knob handle 110 which extends transversely through the leg 96 and is threadedly connected to the insert 34 at the interior threaded channel 42. The leg pivot 104 pivots about a leg pivot axis 104*a*. Preferably, a spacer 112 is located on the fastener 106 between the twist knob handle 110 and the leg 96. Preferably, right and left saddles 114, 116 at least partially envelop the leg 96 at the leg pivot 104. Each saddle 114, 116 includes a flat face 114*a*, 116*a* and an opposing concave face 114*b*, 116*b*, the concave faces 114*b*, 116*b* shaped to snugly accept the leg 96 therebetween. The flat face 114*a* of the right saddle 114 mates with a flat face 34*a* of the insert 34, and a flat face 116*a* of the left saddle 116 mates with a flat face 122 of the spacer 112. The leg pivot 104 allows the leg 96 to pivot in a plane generally perpendicular to the longitudinal axis 24 of the clamp base 14. Those skilled in the art will recognize that, if using a leg 96 with a non-circular cross-section, such as a square cross-section, that the left and right saddles 114, 116 need not necessarily envelop the leg 96.

Figure 7:
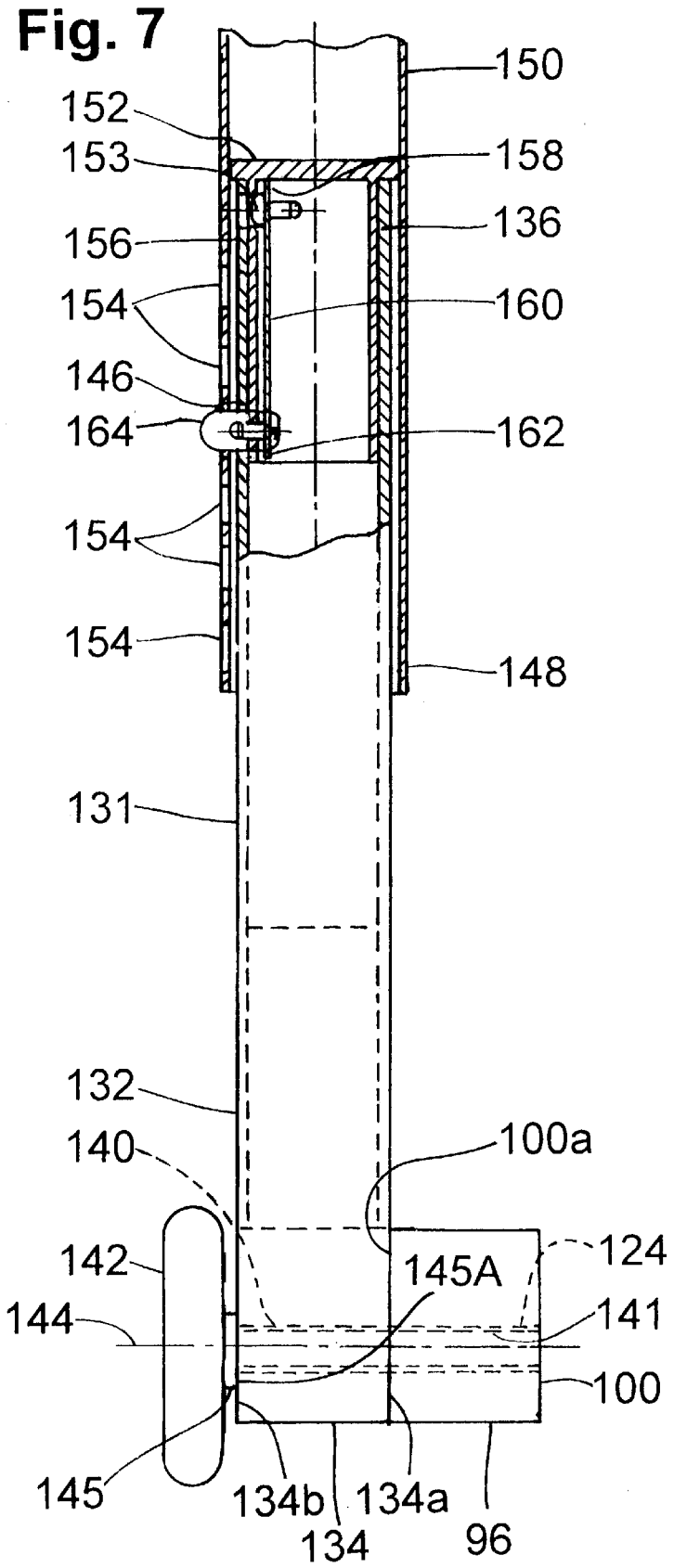
FIG. 7 is an enlarged view of a vertical support and a vertical support securing device.

Referring now to FIGS. 2 and 7, the first leg end 100, forward of the leg pivot 104 (not shown in FIG. 7 for clarity), includes a threaded through hole 124 which extends generally parallel to the clamp base axis 24. Although the leg 96 is preferably tubular, the first leg end 100 includes a flat face 100*a*.

As shown in FIG. 3, a stabilizer 126 adapted to engage a bottom of the seat portion extends from the second leg end 102, generally perpendicular to a longitudinal axis 130 of the leg 96. Preferably, the stabilizer 126 can be fixedly connected to the leg 96, although those skilled in the art will realize that the stabilizer 126 can be pivotally connected to the leg 96, and lockable into a position generally perpendicular to the longitudinal axis 130 of the leg 96. Those skilled in the art will recognize that the stabilizer 126 can be connected to the base 14 instead of to the leg 96.

Referring back to FIGS. 1 and 7, a first portion of the support 131 in the form of the preferably tubular, generally vertical support 132 having first and second vertical support ends 134, 136 extends the chair clamp 12. The support 131 is pivotally connected to the chair clamp 120 at the the first leg end 100. Preferably, a first vertical support end 134 includes a through hole 140 that is co-axial with the through hole 124 in the first leg end 100. Although the vertical support 132 is preferably tubular, the first vertical support end 134 includes a flat face 134 a which mates with the flat face 100*a* of the first leg end 100. Preferably, a threaded fastener 141 with a twist knob 142 extends through the through hole 140 in the vertical support 132 and threads into the threaded through hole 124 in the leg 96 so that the vertical support 132 is pivotally connected to the leg 96 at a horizontally extending vertical support pivot axis 144. The threaded fastener 141 includes a spacer 145 with a flat face 145*a* which engages a flat face 134*b* of the first leg 134 of the vertical support 132. The vertical support 132 includes a through hole 146 which extends radially through the vertical support 132 proximate to the second vertical support end 136 for reasons that will be explained.

Referring still to FIGS. 1 and 7, a second portion of the support 131 in the form of a first end 148 of the support extension 150 is telescopically extendable from outside and rotatable relative to the first portion of the support 131 at the second vertical support end 136. A slide bearing 152 is inserted into the inside of the second vertical end 136 and extends radially outward of the second vertical end 136, slidingly contacting the first end 148 of the support extension 150. The slide bearing 152 provides for a tight fit between the second vertical support end 136 and the first end 148 of the support extension 150 and allows for smooth movement of the support extension 150 along the vertical support 132. Preferably, the slide bearing 152 is constructed from machined Delrin or other similar material. A plurality of co-linear through holes 154 extend radially through the support extension 150 proximate to the first end 148. Preferably, the support extension 150 is releasably securable to the vertical support 132 by a spring and plunger lock 156 which is well known to those skilled in the art. A first end 158 of a leaf spring 160 is fixedly connected to the tube 132, preferably with a rivet 153 or other mechanical connection, and a second end 162 of the leaf spring 160 is fixedly connected to a plunger 164. The plunger 164 is extendable through the through hole 146 in the vertical support 132 and through one of the through holes 154 in the support extension 150 to releasably connect the vertical support 132 to the support extension 150. Those skilled in the art will realize that the support extension 150 can be telescopically connected to the support 131 by other means, including but not limited to a twist ferrule connection or other methods known in the art.

As shown in FIG. 1, a second end 166 of the support extension 150 extends preferably generally perpendicularly to the first end 148 of the support extension 150 and forms a support arm 170.

A third portion of the support 131 in the form of a first end 171 of the arm extension 172 is telescopically extendable from and rotatable relative to the second portion of the support 131 at the second end 166 of the support extension 150. Preferably, the arm extension 172 is releasably securable to the support extension 150 by a threaded fastener 174 includes a handle 174*a* which allows adjustment of the fastener 174. The fastener 174 extends through a through-hole 175 in the second end 166 and frictionally engages the arm extension 172. The second end 176 of the arm extension 172 is connected to the machine clamp 180 such that the clamp 180 is telescopically and rotatably connected to the second end of the second portion. The clamp 180 is adapted to releasably secure the underside of a typical stenographer machine "S" (in phantom) to the arm extension 172.

A first end 182 of an arm 184 extends generally downwardly from the support 131 at the arm extension 172 and is slidably and rotatably located on the arm extension 172. A threaded knob 181 releasably secures the arm 184 to the arm extension 172. A second end 186 of the arm 184 includes an armrest 188 which is adapted to support an operator's forearm. Preferably, the top of the armrest 188 is padded with a cushion 190 or other soft material. Although the armrest 188 is preferred, those skilled in the art will realize that the arm rest 188 and arm 184 can be omitted without departing from the spirit and scope of the present invention.

Although the stand 10 as described and shown is mounted on the chair C such that, as the user is seated, the vertical support 132 is on the user's right hand side (e.g. a "right-handed model"), the stand 10 can also be designed in a mirror image (not shown) so that the vertical support 132 is on the user's left hand side (e.g. a "left-handed model"). A left-handed model may be more practical in particular situations.

Preferably, the clamp base 14, the first and second brackets 20, 22, the leg 96, the vertical support 132, the support extension 150, and the arm extension 172 are all constructed from heat treated aluminum, although hose skilled in the art will realize that these components can be constructed from other materials and need not necessarily be heat treated.

To mount the stand 10 on a chair C, a user, while standing and facing the front of the chair C, slides the stabilizer 126 and the clamp base 14 under the chair seat. The user locates the first bracket 20 so that the cradle 62 is placed flush against the left hand side of the chair C (as viewed in FIG. 1). The user then locates the second bracket 22 so that the cradle 64 is placed flush against the right hand side of the chair (as viewed in FIG. 1). The spacer 56*b* rides along the upper side 90 of the clamp base 14. The spacer 56*a* rides along the lower side 72 and preferably is spaced below the lower side 72 when the user releases the second bracket 22.

The user then aligns the spacer 56*a* in a notch 74 and tightens down on the twist knob handle 82 of the securing device 70. As the user tightens down on the twist knob handle 82, the screw 80 engages the upper side 90 of the clamp base 14 and pivots the second bracket 22 about the spacer 56*a* such that the cradle 64 at the engagement end of the second bracket 22 pivots toward the cradle 62 of the first bracket 20. The user tightens down on the twist knob handle 82 until the first and second brackets 20, 22 are sufficiently tight against the sides of the seat.

The user then loosens the twist knob handle 110 and pivots the leg 96 and the stabilizer 126 such that the stabilizer 126 is tightly located against the bottom of the chair seat. The user then tightens the twist knob handle 110 to lock the stabilizer 126 into position. The spacer 112 is drawn toward the insert 34 by the fastener 106, compressing the saddles 114, 116 and the leg 96 therebetween, providing a frictional engagement between the flat saddle face 114*a* and the flat face 34*a* of the insert 34 and between the flat saddle face 116*a* and the flat face 122 of the spacer 112.

The user then sits in the chair C and secures the stenographic machine S to the machine clamp 180. The user adjusts the location of the stenographic machine S relative to the user's body by selectively adjusting the vertical support 132 relative to the leg 96, the length of the support extension 150 relative to the vertical support 132, the length of the arm extension 172 relative to the second end 166 of the support extension 150 and the angle of the connector 180 relative to the horizontal, and the position and angle of the armrest 186 relative to the user.

To adjust the vertical support 132 relative to the leg 96, the user loosens the twist knob handle 142 and pivots the vertical support 132 relative to the leg 96 until the vertical support 132 is located at a desired position. The user then tightens the twist knob handle 142, securing the vertical support 132 to the leg 96. The spacer 145 is drawn toward the first end 100 of the leg 96 by the fastener 141, compressing the first end 134 of the vertical support 132 therebetween, providing frictional engagements between the flat face 100*a* of the first end 100 of the leg 96 and the first flat face 134*a* of the first end 134 of the vertical support 132 and between the second flat face 134*b* of the first end 134 of the vertical support 132 and the flat face 145*a* of the spacer 145.

To adjust the length of the support extension 150 relative to the vertical support 132, the user pushes in the plunger 164 until the plunger 164 clears the through hole 154 in the support extension 150 through which the plunger 164 extends. The user then either pulls up or pushes down on the support extension 150 until the support extension 150 is at a desired position (height) relative to the vertical support 132 and the plunger 164 is located along one of the through holes 154 in the support extension. The user releases the plunger 164, which locks into the proximate through hole 154 and secures the support extension relative to the vertical support 132.

To adjust the length of the arm extension 172 relative to the second end 166 of the support extension 150, the user loosens the twist knob handle 174 and pulls or pushes the arm extension 172 relative to the second end 166 of the support extension until the second end 176 of the arm extension 172 is at a desired location. While the twist knob handle 174 is loose, the user rotates the arm extension 172 about its longitudinal axis to adjust the angle of the connector 180 relative to the horizontal. When the user obtains the desired length of the arm extension 172 and the desired angle of the connector 10, the user then tightens down on the twist knob handle 174.

If used, the user can adjust the location of the armrest 186 by loosening the threaded knob 181 on the arm 182 and adjusting the position and angle of the armrest 186 relative to the user. When the armrest 186 is in a desired location, the user tightens down on the threaded knob 181, securing the arm 182 to the support arm 170.

The order of adjustment of the pivot of the vertical support 132, the length of the support extension 150 relative to the vertical support 132 and the length of the arm extension 172 relative to the second end 166 of the support extension 150 need not necessarily be performed in the order as described above, and can be performed in any order convenient for the user. Additionally, the stenographic machine S can be connected to the stand 10 at any time during or after adjusting the stand 10.

Although a chair C as shown is a type of chair having a central support post P, other types of chair designs, such as chairs having four legs, can accommodate the stand 10. The stand 10 as described herein allows the user to readily transport the stand from one location to another and mount the stand 10 to virtually any type of office chair.

It will be appreciated by those skilled in the art that changes could be made to the embodiments described above without departing from the broad inventive concept thereof. It is understood, therefore, that this invention is not limited to the particular embodiment disclosed, but it is intended to cover modifications within the spirit and scope of the present invention as defined by the appended claims.

What is claimed is:

1. A combination chair and stand for supporting a stenographic machine from the chair, the chair including a seat portion having lateral sides, the stand comprising:

a. a chair clamp being adjustable along a longitudinal axis of the chair clamp and including a base having first and second ends, a first bracket mounted on the first end of the base, a second bracket adjustably and slidably mounted on the base between the first bracket and the second end of the base, and a securing device operatively connected to the second bracket for securing the second bracket in a selected position such that the first and second brackets releasably, compressively grip the lateral sides of the seat portion;

b. a support having first and second ends, the support extending from the chair clamp; and c. a connector connected to the second end of the support, the connector being adapted to releasably secure the stenographic machine to the stand.

2. The combination chair and stand according to claim 1, wherein the securing device is a screw threadably connected to the second bracket wherein tightening of the screw pivots an engagement end of the second bracket toward the first bracket.

3. The combination chair and stand according to claim 1 wherein the support includes a first portion telescopically connected to a second portion.

4. The combination chair and stand according to claim 3 wherein the second portion is telescopically connected to a third portion.

5. The combination chair and stand according to claim 4 wherein the connector is rotatably connected to the second end of the support.

6. The combination chair and stand according to claim 1 wherein the connector is telescopically connected to the second end of the support.

7. The combination chair and stand according to claim 1 further comprising a stabilizer extending from the support, the stabilizer being adapted to engage a bottom of the seat portion.

8. The combination chair and stand according to claim 1 wherein the support is pivotally connected to the chair clamp.

9. The combination chair and stand according to claim 1 wherein the chair clamp and the support are constructed of aluminum.

10. The combination chair and stand according to claim 1 further comprising an arm extending from the support.

11. The combination chair and stand according to claim 10 wherein the arm is adapted to support an operator's forearms.

12. A combination chair and stand for supporting a stenographic machine from the chair, the chair including a seat portion having lateral sides, the stand comprising:

a. a chair clamp being adjustable along a longitudinal axis of the chair clamp and including a base having first and second ends, a first bracket mounted on the first end of the base, a second bracket adjustably and slidably mounted on the base between the first bracket and the second end of the base, and a securing device operatively connected to the second bracket for securing the second bracket in a selected position such that the first and second brackets releasably, compressively grip the lateral sides of the seat portion;

b. a support extending from the chair clamp, the support having first and second ends, the first end being pivotally connected to the chair clamp, the support including a first portion telescopically connected to a second portion, and the second portion being telescopically connected to a third portion;

c. a stabilizer extending from the first end of the support, the stabilizer being adapted to engage a bottom of the seat portion;

d. an arm extending from the second end of the support, the arm being adapted to support an operator's forearm; and e. a connector connected to the third portion, the connector being adapted to releasably secure the stenographic machine to the stand.

13. The combination chair and stand according to claim 12 wherein the securing device is a screw threadably connected to the second bracket wherein tightening of the screw pivots the second bracket toward the first bracket.

14. The combination chair and stand according to claim 12 wherein the chair clamp and the support are constructed of aluminum.

* * * * *